US009138613B2

(12) United States Patent
Ferrell

(10) Patent No.: US 9,138,613 B2
(45) Date of Patent: Sep. 22, 2015

(54) WEIGHTLIFTING AID

(71) Applicant: Steven E. Ferrell, Ruckersville, VA (US)

(72) Inventor: Steven E. Ferrell, Ruckersville, VA (US)

(73) Assignee: Steven E. Ferrell, Ruckersville, VA (US)

( * ) Notice: Subject to any disclaimer, the term of this patent is extended or adjusted under 35 U.S.C. 154(b) by 89 days.

(21) Appl. No.: 13/987,753

(22) Filed: Aug. 29, 2013

(65) Prior Publication Data

US 2015/0065315 A1 Mar. 5, 2015

(51) Int. Cl.
*A63B 21/078* (2006.01)

(52) U.S. Cl.
CPC ..... *A63B 21/078* (2013.01); *A63B 2021/0783* (2013.01)

(58) Field of Classification Search
CPC ..... A63B 21/00047; A63B 21/0724; A63B 21/0728; A63B 21/078; A63B 21/072–2021/0786
USPC ..... 482/104, 106–108, 907
See application file for complete search history.

(56) References Cited

U.S. PATENT DOCUMENTS

| | | | | |
|---|---|---|---|---|
| 5,433,686 | A | 7/1995 | Marsh | |
| 5,897,468 | A | 4/1999 | Lumpkin | |
| 5,933,874 | A | 8/1999 | Randolph | |
| 6,224,518 | B1 * | 5/2001 | Weiss et al. | 482/93 |
| 6,676,575 | B1 | 1/2004 | Mayo | |
| 2012/0165163 | A1 | 6/2012 | Barrow | |
| 2012/0329623 | A1 * | 12/2012 | Ramirez | 482/139 |

* cited by examiner

*Primary Examiner* — Loan H Tranh
*Assistant Examiner* — Jennifer M Deichl

(57) ABSTRACT

According to the invention there is provided an improved weightlifting aid and method of use thereof, comprising: a barbell supporting block element; and a plurality of barbell contacting arrangements for attaching different sides of the block element to a barbell; in which the one or more barbell contacting arrangements are releasably connectable to the barbell; so as to secure the block element to the barbell above the chest of a user performing a bench press exercise, the block element being of adjustable height depending on which part of the block element is attached to the barbell.

4 Claims, 4 Drawing Sheets

WEIGHTLIFTING AID

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

This invention relates to a weightlifting aid and a method of weightlifting, with particular reference to bench pressing and other weightlifting movements performed from a recumbent position.

2. Description of Related Art

Generally, to perform a bench press, a person lies in a recumbent position on a bench that is parallel or angled to the ground, grasps a barbell that is positioned on a rack above the person's head, lowers the barbell until it touches the person's chest, and then lifts the barbell to a position that is over the person's chest with the person's arms essentially fully extended. It is known that, for a variety of reasons, it can be desirable to initiate a bench press exercise from a range of starting positions higher than the user's chest. For instance, raising the starting position allows the user to perform a bench press exercise with heavier weights. To this end, a number of stackable wooden boards are commonly placed on a weightlifter's chest so that the minimum position of the barbell is at a desired distance from the weightlifter's chest. This practice requires at least one other person (commonly known as a "spotter") to be present to hold on to the boards.

In the prior art, a number of devices and/or methods have been proposed to allow the weightlifter to initiate a bench press from a range of starting positions without the need for a spotter—see for example, U.S. Pat. Nos. 6,224,518, 5,433,686, and 5,897,468. In particular, U.S. Pat. No. 6,224,518 describes a method for reducing shoulder injury during the performance of a bench press exercise. The method entails the use of a cylindrical pad adapted to be coupled to a barbell substantially over the chest of a user, and having sufficient thickness to prevent a user performing a bench-press-type exercise from lowering his or her upper arms below a horizontal plane defined by the user's back. This method and device have the sole purpose and function of ensuring that a user performing a bench press lowers the barbell to the point where the upper arms descend to the horizontal plane defined by the back of the user. The thickness of the cylindrical pad is fixed and cannot be adjusted. Thus, the method disclosed in U.S. Pat. No. 6,224,518 does not allow the user to initiate a bench press from a range of starting positions. This is a significant limitation, as raising the height of the starting position for a bench press allows the user to perform the movement with heavier weights.

Similarly, U.S. Pat. No. 5,897,468 describes a training aid which is intended to reduce the risk of injury to the arm and shoulder of a user and provide assistance to a user who is attempting to lift a somewhat increased weight. The training aid disclosed in U.S. Pat. No. 5,897,468 comprises a harness having a pair of relatively small spaced apart pockets. A plurality of spacers can be stored in each pocket to an overall height of up to about 4 cm in order to prevent the barbell from touching the chest of the user, thereby rendering the weightlifting exercise easier. Another embodiment is proposed in which a single pair of spaced apart spacers are attached to the training aid using a hook and loop fastener material.

U.S. Pat. Application No. 20120165163 A1 describes a weightlifting aid having a harness for attaching the aid to the chest area of the user; a base region in connection with the harness; and a plurality of interconnectable board elements; in which at least one board element is also connectable to the base region, so as to form a stack of board elements on top of the user's chest, the stack being of adjustable height depending on the number of barbell supporting boards used to form the stack. Thus, the user may initiate a bench press from a range of starting positions by adding to or subtracting from the number of board elements stacked on the user's chest.

The weightlifting aid described in U.S. Pat. App. No. 20120165163 A1 is highly impractical and potentially unsafe for several reasons. First, a user wishing to initiate a bench press from a range of starting positions is required to engage in a cumbersome and time consuming process of adding and removing boards from a stack of boards strapped to the user's chest. The fact that the user must remain lying on his or her back (to prevent the stack from falling over) while adding or removing boards further compounds the cumbersome and potentially dangerous nature of this aid. Second, the aid comprises several board elements of considerable size and weight, which would make transporting the aid to a gym extremely impractical or impossible. For instance, the boards would not likely fit into a duffle bag or backpack, and transporting the aid in multiple bags would be impractical and undesirable for many users, particularly those users who travel by foot, bicycle, or public transportation. Third, use of the weightlifting aid in U.S. Pat. App. No. 20120165163 A1 requires a vertical alignment of the board elements stacked on the user's chest with the vertical path of the barbell during exercise. Because the vertical path of the barbell is necessarily perpendicular to the floor, use of the aid is limited to exercises in which the user's body is in a recumbent position parallel to the floor. Thus, the weightlifting aid disclosed in U.S. Pat. App. No. 20120165163 A1 aid could not be used for exercises performed on an incline or decline bench, as the angled position of the user's chest in relation to the vertical path of the barbell during exercise would prevent the stacked board elements from aligning with the barbell during exercise. This presents a significant limitation for users wishing to perform bench press exercises from a variable range of starting locations on an incline or decline bench.

The present inventor has realized that there is a need for a device which can be used by a weightlifter to perform a range of bench press type exercises at a significant and variable range of heights and angles, which can be used safely and efficiently without the assistance of another person, and which is small, lightweight, and can be easily transported or stored in a small duffle bag.

According to a first aspect of the invention there is provided a weightlifting aid including: a barbell supporting block element and a plurality of barbell contacting arrangements for attaching the block element to a barbell; in which the one or more barbell contacting arrangements are releasably connectable to the barbell; so as to secure the block element to the barbell above the chest of a user, the block element being of adjustable height depending on which side of the block element is attached to the barbell.

In this way, the above described needs can be met. In contrast, the training aid of U.S. Pat. No. 5,897,468 acts as a stop block for the barbell close to the chest of the user, and does not suggest that a range of beneficial and differing exercises can be performed by providing a taller platform of variable height. In any event, the use of two separate and rather thin spacers as proposed in U.S. Pat. No. 5,897,468 are unlikely to prove to be sturdy, certainly at significant clearances from the user's chest, and could easily topple should a heavy weight be rested on them, or if the barbell is lowered at an angle or with a twisting motion. This could cause serious injury to the weightlifter.

The skilled reader will appreciate that the block element of the present invention does not necessarily have a weight bearing impact on the chest area of the user, but rather may be lightly touched to the user's chest before initiating the bench press movement. Further, because the present invention attaches to the barbell rather than to the chest of the user, it easily accommodates multiple users. In contrast, the training aids U.S. Pat. No. 5,897,468 and U.S. Pat. App. No. 20120165163 A1 each require the user to don a harness apparatus to which boards or spacers must be secured. The harness structure makes these aids impractical and cumbersome for use by multiple persons, such as training partners, as the harness must removed and refitted, and the boards or spacers removed and reinstalled, for each successive user. This time-consuming process may be undesirable for users having limited time for exercise. Such users are likely to prefer the ease and efficiency of the aid of the present invention, which does not involve a harness that must be removed and refitted, or boards or spacers that must be removed and reinstalled.

Further, the aid of the present invention may be used to be perform bench press exercises on an incline or decline bench, as well as on a flat bench. In contrast, the use of aids which require boards or spacers to be stacked on the users chest, such as those described in U.S. Pat. No. 5,897,468 and U.S. Pat. App. No. 20120165163 A1, is limited to exercise performed on a flat bench, in which the user's body is in a recumbent position parallel to the floor. These aids do not allow use on an incline or decline bench, as the angled position of the user's chest in relation to the vertical path of the barbell during exercise would prevent the stacked boards or spacers from aligning with the barbell during exercise.

For these and other reasons, the aid of the present invention provides a significant and much needed improvement over the prior art.

SUMMARY OF THE INVENTION

An improved weightlifting aid which allows a user to quickly, safely, and precisely adjust the starting location and total distance of a bench press movement.

DESCRIPTION OF A PREFERRED EMBODIMENT

1. Definitions

In the summary above and the description below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The terms "includes," "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

2. Overview

The present invention allows a user to adjust the starting location and total distance of a bench press movement. A person performing a bench press exercise without the aid of the present invention must move the barbell upward from the person's chest to a position over the person's chest with the arms fully extended. Thus, the movement is initiated from a starting position located at the person's chest, and the total distance of the movement is approximately the equal to the length of the person's arms. With the aid of the present invention, a user performing a bench press initiates the movement from a starting position located a distance above the user's chest equal to the height of the barbell supporting block element when a bottom portion of the block element is contacting the user's chest. Thus, the user moves the barbell a total distance equal to the length of the user's arms minus the height of the block element.

The aid of the present invention allows the user to raise or lower the starting location and decrease or increase total distance of the bench press movement by adjusting the vertical height of the block element. Increasing the vertical height of the block element raises the starting point and thereby decreases the total distance of the movement. Conversely, by decreasing the height of the block element, the user lowers the starting point and thereby increases the total distance of the movement. Adjusting the height of the block element is easily, quickly and safely accomplished simply by attaching a different part or side of the block element to the barbell.

One embodiment of the present invention comprises a rectangular block element having a width greater than its thickness and a length greater than its width. The block element includes a plurality of recesses for attaching the block element to a barbell, the recesses being located on at least one end, one side, and one face of the block element, so that the height of the block element may be adjusted depending on which part of the block element is attached to the barbell.

Thus, the user may adjust the starting position and total distance of the movement by attaching a different part of the block element to the barbell. For instance, the greatest distance of movement is achieved by attaching one face of the block element to the barbell, so that the vertical height of the block element is equal to its thickness. Likewise, the shortest distance of movement is achieved by attaching one end of block element to the barbell, so that the height of the block element is equal to its length. An intermediate distance of movement is achieved by attaching one side of the block element to the barbell, so that the height of the block element is equal to its width.

3. Brief Description of the Drawings

FIGS. 4*a*-4*d* are perspective views showing a typical use of the weightlifting aid.

Figure 5:
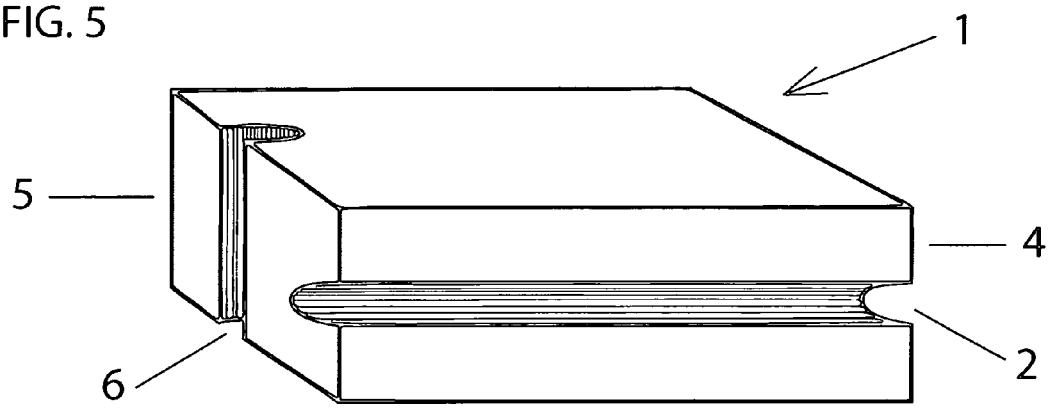

FIG. 5 shows an alternative embodiment of the present invention.

Figure 6:
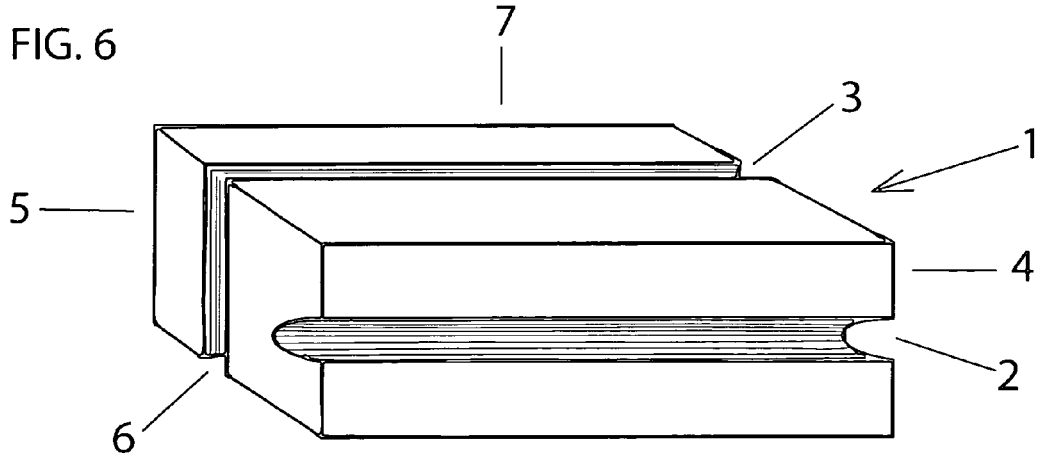

FIG. 6 shows a second alternative embodiment of the present invention.

Figure 7:
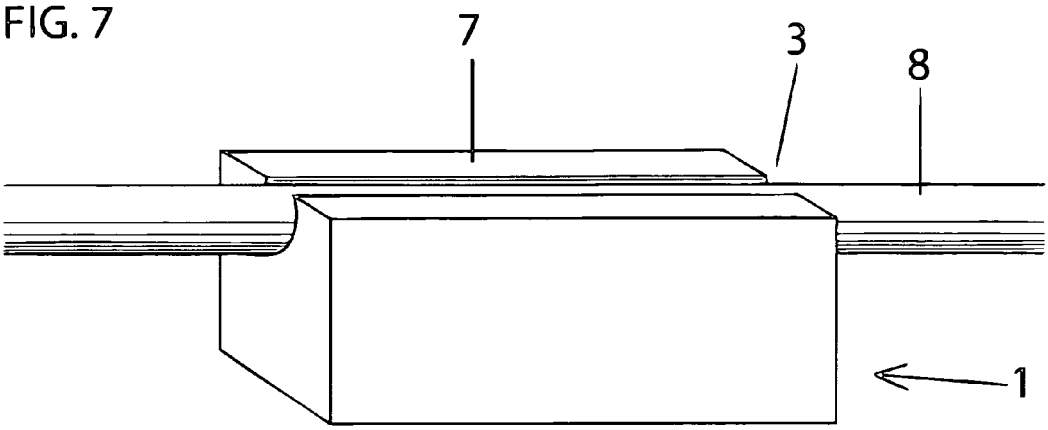

FIG. 7 is a perspective view showing the aid connected to a barbell using a recess located on one side of the block element.

Figure 8:
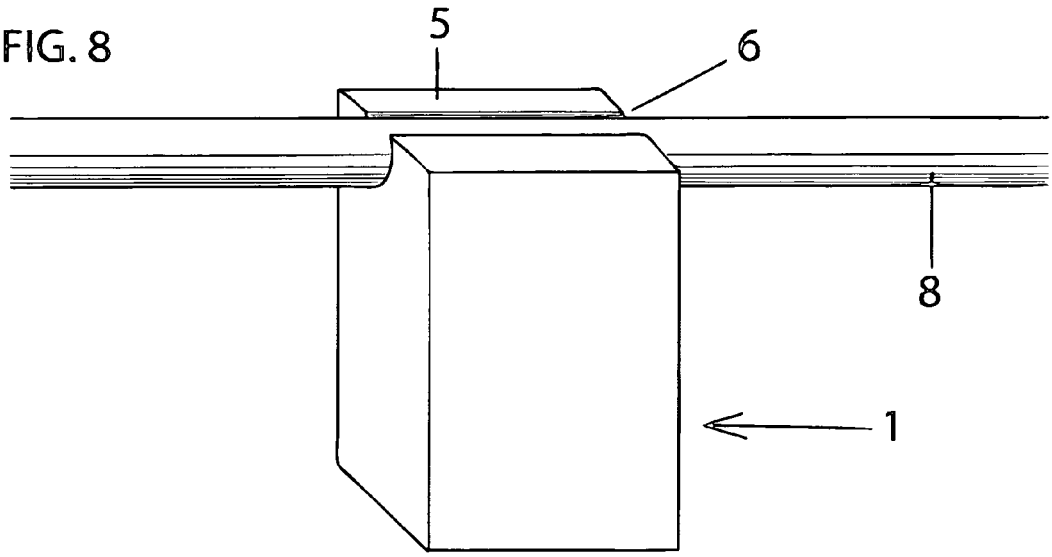

FIG. 8 is a perspective view showing the aid connected to a barbell using a recess located on one end of the block element.

4. Detailed Description of the Elements

Figure 1:
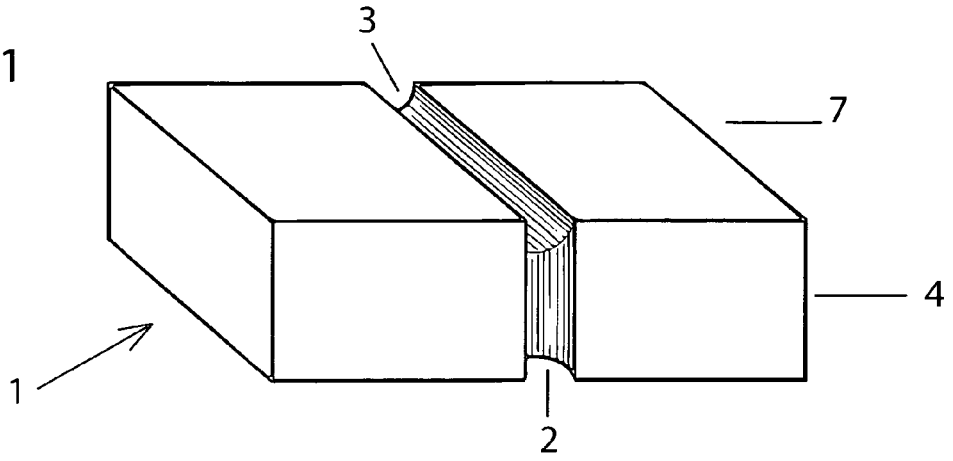
FIG. 1 shows a weightlifting aid constructed in accordance with the present invention.

FIG. 1 shows a weightlifting aid constructed in accordance with the present invention, which comprises a block element 1 and barbell connecting elements 2 and 3 located on the front side 4 and top face 7 of block element 1.

It can be seen that the block element 1 has a rectangular shape of a length greater than its width and a width greater than its thickness. The barbell contacting elements on front side 4 and top face 7 are depicted as recesses therein which are shaped so that the projection of a center portion of a barbell can fit snugly into either recess and thereby be releasably but securely attached to block element 1. It will be apparent to the skilled reader that many variations of this principle are possible. For example, the barbell connecting elements may be differently shaped and/or there may be a different number of barbell connecting elements.

Figure 2:
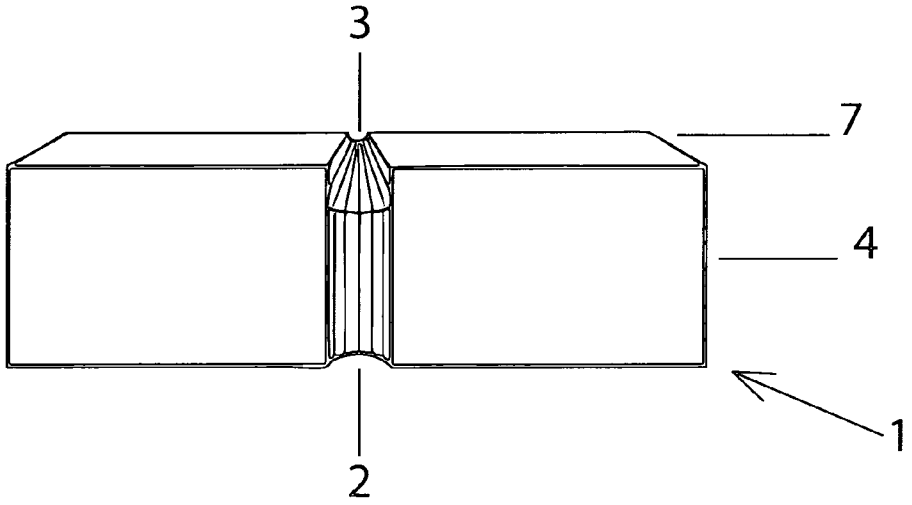
FIG. 2 is a front perspective view thereof.

FIG. 2 is a front perspective view thereof, showing the front side 4 of block element 1 in more detail. Barbell connecting elements 2 and 3 are depicted as recesses located on the front side 4 and top face 7 of block element 1, the recesses being sized to accept a projection of the center portion of a barbell. Thus, block element 1 may be releasably connected to a barbell by securing the projection of the center portion of the barbell in either recess.

Figure 3:
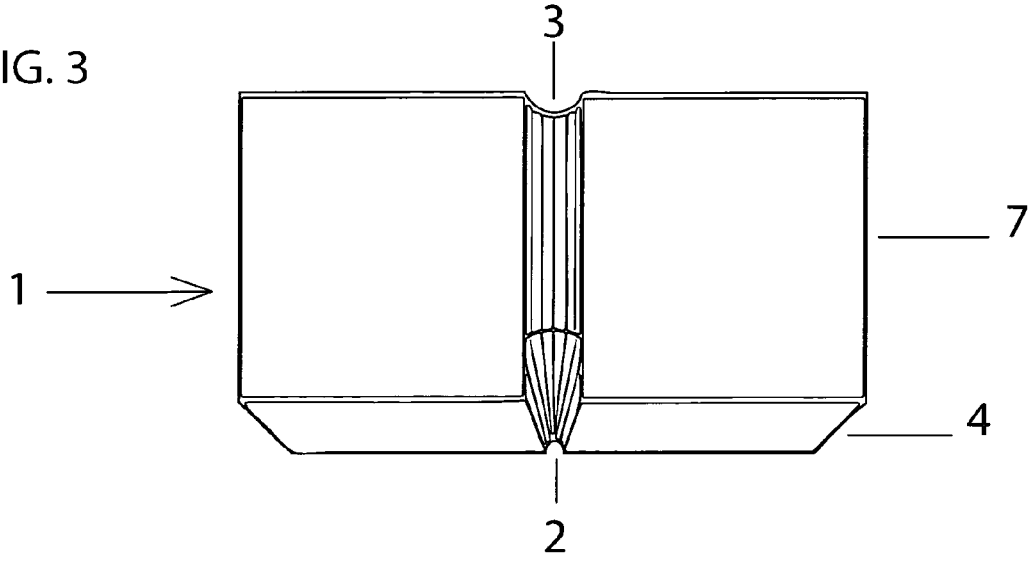
FIG. 3 is a top perspective view thereof.

FIG. 3 is a top perspective view thereof, showing the top face 7 of block element 1 in more detail. Again, barbell connecting elements 2 and 3 are depicted as recesses located on the top face 7 and front side 4 of block element 1, the recesses being sized to accept a projection of the center portion of a barbell. Note that the vertical height of block element 1 will vary depending upon which recess is used to secure block element 1 to a barbell, the vertical height of block element being the distance block element 1 protrudes away from the barbell. If the recess on the front side 4 is used, the vertical height of block element 1 will equal approximately the width of block element 1. If the recess on the top face 7 is used, the vertical height of block element 1 will equal approximately the thickness of block element 1.

The block element can be connected to a barbell in the manner described above in order to vary the vertical height of block element 1 as shown in FIGS. 7 and 8. The vertical height of block element 1 can be varied in accordance with the user's wishes in order to vary the nature of the exercise performed. The use of the training aid with the block element connected to a barbell reduces the range of motion covered in a bench press exercise. The greater the vertical height of block element 1 employed, the greater the height of the starting position of the bench press movement, and the less the range of motion covered in the bench press. An advantage with reducing the range of motion is that a user can strengthen weak points in his or her bench press action. For example, if a user were to find that there is a tendency to fail at one-third extension when using heavier weights, then an appropriate height of block element 1 could be used so that the user can practice lifting from this position, which corresponds generally to the position shown in FIG. 4*c*.

Figure 4A:
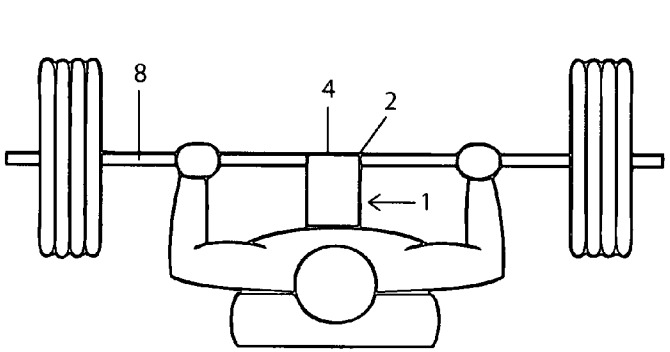
Figure 4B:
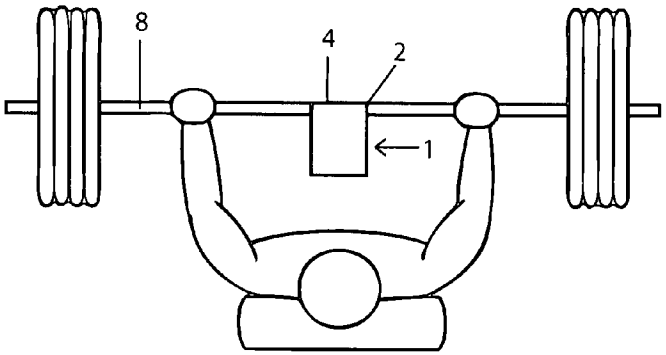
Figure 4C:
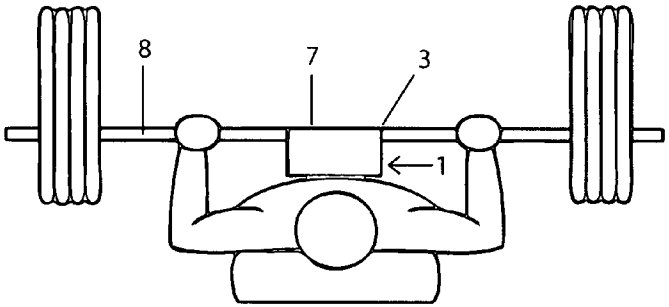
Figure 4D:
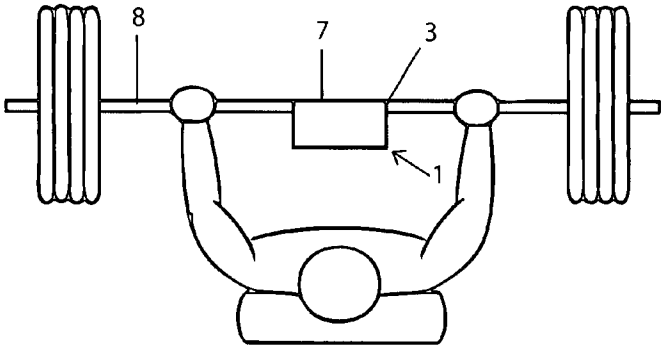

FIGS. 4*a*-4*d* show typical uses of the weightlifting aid in performing a bench press from a range of starting positions. FIG. 4*a* and FIG. 4*b* show a typical use in which block element 1 is connected to a barbell 8 using barbell connecting element 2 located on front side 4 of block element 1, so that the vertical height of block element 1 equals the width of block element 1. Note that the same vertical height of block element 1 would be achieved with use of a barbell connecting element located on the opposite side of block element 1. FIG. 4*c* and FIG. 4*d* show a typical use of the aid in which block element 1 is connected to barbell 8 using barbell connecting element 3 located on the top face 7 of block element 1, so that the vertical height of block element 1 equals the thickness of block element 1. This configuration is depicted in more detail in FIG. 7. Note that the same vertical height of block element 1 would be achieved with use of a barbell connecting element located on the opposite face of block element 1.

FIGS. 4*a* and 4*b* show the use of a relatively tall configuration of block element 1 which enables the user to overload the upper end of his or her range of motion. Exercising this configuration allows the user to become used to holding heavier weights, as well as focusing the exercise on the triceps. As a further benefit, the block element is sufficiently narrow to allow the user to perform a close grip bench press, which is a bench press exercise used to focus on the development of the triceps.

Another useful exercise which can be performed using the present invention is a "drop set" workout wherein the height of the block element is varied so that exercises are performed with variable starting heights of the barbell. This can be performed by commencing a bench press set using a relatively tall configuration of the block element which is then successively adjusted to decrease the height of the block element. Each time the height of the block element is decreased, the user performs a number of reps. This can be continued until the lowest configuration of the block element has been used, or the block element has been removed altogether. Alternatively, the drop set can be performed in an opposite manner, i.e., the user begins without the block element in place, with the block element successively added to the barbell and the height of the block element successively increased. With use of the present invention, a drop set could be performed without an assistant as the user could easily adjust the block element to increase or decrease its height.

FIG. 5 shows an alternative embodiment of the present invention having barbell connecting elements 2 and 6 located on the front side 4 and left end 5 of block element 1. Like the embodiment depicted in FIG. 4, this embodiment allows the user to connect front side 4 of block element 1 to a barbell, so that the vertical height of block element 1 equals the width of block element 1. This embodiment further allows a user to connect the left end 5 of block element 1 to the barbell, so that the vertical height of block element 1 equals the length of block element 1. Note that the same vertical height of block element 1 would be achieved with use of a barbell connecting element located on the opposite end of block element 1.

FIG. 6 shows an alternative embodiment of the present invention, having barbell connecting elements 2, 3, and 6 located on the front side 4, top face 7, and left end 5 of block element 1. This embodiment allows a user to connect block element 1 to a barbell such that the vertical height of block element 1 equals the thickness, width, or length of block element 1, depending on which barbell connecting element is used.

FIG. 7 is a perspective view showing the aid connected to a barbell 8 using barbell connecting element 3 located on the top face 7 of block element 1, so that the height of block element 1 approximately equals the thickness of block element 1. A typical use of this configuration is depicted in FIGS. 4*c* and 4*d*.

FIG. 8 is a perspective view showing the aid connected to barbell 8 using a barbell connecting element 6 on the left end 5 of block element 1, so that the vertical height of block element 1 equals approximately the length of block element 1.

It is preferred that the block element is formed from a relatively high density rubber or foam material. Such materials are relatively light, but provide sufficient resilience against the weight of the barbell. Representative dimensions for the block element are 9 in.×5 in.×3 in. It is desired that the block element is sufficiently wide to extend over a substantial portion of the users chest in order to provide a suitably stable structure. In general, this requirement is manifest in the block element having a width of 5 in. or greater.

Numerous variations to the embodiments described above would suggest themselves to the skilled reader. For example, a block element might be provided having a different shape that allows the block element to be set at a greater variety of heights.

5. Preferred Advantages

Preferred advantages of this invention include, without limitation, the following:

To provide an improved weightlifting aid that can be used by a weightlifter to perform a range of bench press type exercises at a significant and variable range of heights and angles, which can be used safely and efficiently without the assistance of another person, which can easily accommodate multiple users, and which is small, lightweight, and can be easily transported to and from a gym in a small duffle bag.

It is not necessary for all embodiments of the invention to have all the advantages of the invention or fulfill all the purposes of the invention.

6. Broad Embodiment

In broad embodiment, the present invention is a weightlifting aid having a barbell supporting block element and a plurality of barbell contacting arrangements for attaching the block element to a barbell, the vertical height of the block element being adjustable depending on which part of the block element is attached to the barbell.

What is claimed is:

1. A method of weightlifting by a person including the steps of:

i) providing a weightlifting aid, wherein said weightlifting aid comprises a block element having a plurality of recesses sized to accept a center portion of a barbell and thereby releasably connect the block element to the barbell;

wherein a length of the block element is greater than a width of the block element and the width of the block element is greater than a thickness of the block element;

wherein the plurality of recesses are respectively provided on at least two adjacent sides of the block element so that a vertical height of the block element may be adjusted by changing the side of the block element attached to the barbell;

wherein the block element is formed from foam;

ii) attaching the weightlifting aid to the center portion of a barbell;

iii) assuming a recumbent bench press position; and iv) performing a bench press exercise with the barbell.

2. The method of weightlifting by a person according to claim 1, further comprising the step of adjusting the height of the block element and performing an additional bench press exercise.

3. A weightlifting system comprising:

a barbell;

a weightlifting aid, wherein said aid comprises:

a block element having a plurality of recesses sized to accept a center portion of the barbell and thereby releasably connect the block element to the barbell;

wherein a length of the block element is greater than a width of the block element and the width of the block element is greater than a thickness of the block element;

wherein the plurality of recesses are respectively provided on at least two adjacent sides of the block element so that a vertical height of the block element may be adjusted by changing the side of the block element attached to the barbell; and wherein the center portion of the barbell is provided in one of the plurality of recesses of the block element.

4. The weightlifting system according to claim 3, wherein the block element is formed from foam.

* * * * *